US010008159B2

(12) United States Patent
Song

(10) Patent No.: US 10,008,159 B2
(45) Date of Patent: Jun. 26, 2018

(54) ORGANIC ELECTROLUMINESCENT DISPLAY PANEL, DISPLAY APPARATUS AND LUMINANCE COMPENSATION METHOD

(71) Applicant: Boe Technology Group Co., Ltd., Beijing (CN)

(72) Inventor: Danna Song, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 0 days. days.

(21) Appl. No.: 15/322,545

(22) PCT Filed: Apr. 15, 2016

(86) PCT No.: PCT/CN2016/079436
§ 371 (c)(1),
(2) Date: Dec. 28, 2016

(87) PCT Pub. No.: WO2016/184282
PCT Pub. Date: Nov. 24, 2016

(65) Prior Publication Data

US 2017/0169767 A1 Jun. 15, 2017

(30) Foreign Application Priority Data

May 15, 2015 (CN) ..... 2015 1 0251479

(51) Int. Cl.
*G09G 3/32* (2016.01)
*G09G 3/3291* (2016.01)
*G09G 3/3241* (2016.01)

(52) U.S. Cl.
CPC ..... *G09G 3/3291* (2013.01); *G09G 3/3241* (2013.01); *G09G 2300/0819* (2013.01);
(Continued)

(58) Field of Classification Search
CPC ..... G09G 3/20–3/3291
See application file for complete search history.

(56) References Cited

U.S. PATENT DOCUMENTS

2014/0152633 A1* 6/2014 Park ..... G09G 3/3291 345/207
2014/0225938 A1* 8/2014 Soni ..... G09G 3/3233 345/690

(Continued)

FOREIGN PATENT DOCUMENTS

CN 101859529 10/2010
CN 101960509 1/2011

(Continued)

OTHER PUBLICATIONS

International Search Report for PCT/CN2016/079436 dated Jul. 5, 2016.

(Continued)

*Primary Examiner* — Lin Li
(74) *Attorney, Agent, or Firm* — Calfee, Halter & Griswold LLP

(57) ABSTRACT

An organic electroluminescent display panel and a display apparatus are disclosed. At a first detection phase, aging of the light-emitting device in each sub-pixel is detected one by one. At a display phase, an initial grayscale value for a corresponding sub-pixel is compensated in accordance with the aging of the light-emitting device in each sub-pixel. Moreover, in the display panel the plurality of sub-pixels that belong to the same pixel group share a sense line, such that the number of the wirings in the display panel can be reduced and the number of the signal channels of the driving chip can thus be reduced, leading to a reduced area of the driving chip and a reduced manufacture cost.

16 Claims, 9 Drawing Sheets

Fig. 2

(52) U.S. Cl.
CPC ..... *G09G 2320/0233* (2013.01); *G09G 2320/045* (2013.01); *G09G 2320/048* (2013.01); *G09G 2330/12* (2013.01)

(56) References Cited

U.S. PATENT DOCUMENTS

| | | | | |
|---|---|---|---|---|
| 2014/0292342 | A1 | 10/2014 | Chaji | |
| 2015/0123953 | A1 | 5/2015 | Shim et al. | |
| 2015/0145845 | A1* | 5/2015 | Nam ..... | G09G 3/3233 345/209 |

FOREIGN PATENT DOCUMENTS

| | | |
|---|---|---|
| CN | 102687193 | 9/2012 |
| CN | 102725786 | 10/2012 |
| CN | 103854602 | 6/2014 |
| CN | 103854603 | 6/2014 |
| CN | 104809986 | 7/2015 |

OTHER PUBLICATIONS

Office Action from China Application No. 201510251479.0 dated Nov. 26, 2015.

* cited by examiner

ORGANIC ELECTROLUMINESCENT DISPLAY PANEL, DISPLAY APPARATUS AND LUMINANCE COMPENSATION METHOD

RELATED APPLICATIONS

The present application is the U.S. national phase entry of the international application PCT/CN2016/079436, with an international filing date of Apr. 15, 2016, which claims the benefit of Chinese Patent Application No. 201510251479.0, filed on May 15, 2015, the entire disclosures of which are incorporated herein by reference.

TECHNICAL FIELD

The present disclosure relates to the field of display technologies, and particularly to an organic electroluminescent display panel, a display apparatus, and a method for luminance compensation of an organic electroluminescent display panel.

BACKGROUND

As an electric current type of light-emitting device, organic light emitting diodes (OLEDs) have found wide application in high performance displays. With the increase in the size of the display, traditional passive matrix organic light-emitting diode (PMOLED) displays require shorter driving time for a single pixel, which necessitates an increased transient current and increased power consumption. Meanwhile, application of a large current results in a large voltage drop on the ITO wire and a high working voltage of the OLED, and in turn decreases its efficiency. Active matrix organic light-emitting diode (AMOLED) displays may address these issues elegantly by means of switch transistors scanning and inputting currents for OLEDs line by line.

Among the three types of driving approaches for AMOLED, which are digital driving, current driving and voltage driving, the voltage driving approach is similar to the traditional driving approach for active matrix liquid crystal displays (AMLCDs), i.e., providing by a driving chip (IC) a voltage signal that represents a grayscale, which voltage signal would be converted inside a sub-pixel into a current signal for driving a thin film transistor, so as to drive the OLED to exhibit a luminance grayscale. This approach is advantageous in that it is fast in driving speed, simple to implement, and appropriate for driving large-sized panels, and thus is extensively applied in the industry.

However, in an AMOLED display of the voltage driving type, the current-luminance (I-L) conversion efficiency decreases as the OLED ages over time. Even if the currents are the same, the luminance displayed may be different because due to their different aging degrees the OLEDs are different in their conversion efficiencies. This leads to an issue that non-uniformity of the luminance is present in the images displayed on the display panel.

In order to improve the luminance uniformity, external compensation approaches are generally applied at present for the AMOLED display of the voltage driving type. Namely, each sub-pixel of the display panel is connected with a driving chip through a respective sense line corresponding one-to-one thereto, which driving chip detects the aging of the OLEDs in respective sub-pixels through the respective sense lines and then performs compensation of the sub-pixels in accordance with the detection. Nevertheless, in the above display panel, each sub-pixel is connected to a respective sense line, leading to increased wirings in the display panel, which is disadvantageous for fabrication of a high resolution display panel. Moreover, the number of the signal channels of the driving chip will be doubled, resulting in an increased area of the driving chip and a high cost.

SUMMARY

In view of this, embodiments of the present disclosure provide an organic electroluminescent display panel, a display apparatus, and a method for luminance compensation of an organic electroluminescent display panel to not only achieve compensation of the aging of the light-emitting devices in the organic electroluminescent display panel but also reduce the sense lines in the display panel and in turn, to reduce the number of the signal channels of the driving chip and thus the cost.

An organic electroluminescent display panel according to an embodiment of the present disclosure includes a plurality of rows of sub-pixels and a driving chip connected with the sub-pixels through respective data lines, and at least two adjacent sub-pixels in the same row form a pixel group. The display panel further includes sense lines corresponding one-to-one to the pixel groups, and first gate lines and second gate lines that are connected with respective rows of sub-pixels. Each of the sense lines is connected with a respective signal channel of the driving chip.

The sub-pixel includes a driving transistor, a capacitor connected between a source and a gate of the driving transistor, a data write unit, a detection unit and a light-emitting device. An input terminal of the data write unit is connected with a corresponding one of the data lines, a control terminal thereof is connected with a corresponding one of the first gate lines, and an output terminal thereof is connected with the gate of the driving transistor and a first terminal of the capacitor. An input terminal of the detection unit is connected with the source of the driving transistor, a second terminal of the capacitor and a first terminal of the light-emitting device, respectively, a control terminal thereof is connected with a corresponding one of the second gate lines, and an output terminal thereof is connected with one of the sense lines that corresponds to the pixel group to which the sub-pixel belongs. A drain of the driving transistor is connected with a first reference signal terminal, and a second terminal of the light-emitting device is connected with a second reference signal terminal.

For each pixel group, the driving chip is configured to detect aging of the light-emitting device in each sub-pixel one by one at a first detection phase, and compensate an initial grayscale value for a corresponding sub-pixel in accordance with the aging of the light-emitting device in each sub-pixel at a display phase.

Optionally, detecting the aging of the light-emitting device in each sub-pixel includes: writing, by the data write unit, a first preset voltage larger than a threshold voltage of the driving transistor to the gate of the driving transistor; receiving, by the detection unit, a driving current for the driving transistor driving the light-emitting device to emit light; calculating the driving current by calculating an amount of change in a voltage on the corresponding sense line; adjusting a voltage of the gate of the driving transistor until the amount of change in the voltage on the sense line equals a preset value; and determining the aging of the light-emitting device by calculating an amount of change in the voltage of the gate of the driving transistor.

Optionally, in the organic electroluminescent display panel according to an embodiment of the present disclosure, the determining the aging of the light-emitting device by calculating the amount of change in the voltage of the gate of the driving transistor includes:

calculating a difference between the voltage of the gate of the driving transistor and the first preset voltage when the amount of change in the voltage on the sense line equals the preset value;

determining an amount of change in a driving voltage for the driving transistor driving the light-emitting device from the difference;

comparing the determined amount of change in the driving voltage with a pre-established correspondence between the amount of change in the driving voltage and a percentage of attenuation of a luminous efficiency of the light-emitting device, to determine the percentage of attenuation of the luminous efficiency of the light-emitting device, wherein the percentage of attenuation of the luminous efficiency represents a ratio of an attenuated luminous efficiency to an initial luminous efficiency of the light-emitting device.

Optionally, in the organic electroluminescent display panel according to an embodiment of the present disclosure, compensating for the corresponding sub-pixel in accordance with the aging of the light-emitting device in each sub-pixel includes:

determining for each sub-pixel an initial luminance value corresponding to the initial grayscale value for the sub-pixel; dividing the determined initial luminance value by the percentage of attenuation of the luminous efficiency of the corresponding light-emitting device to derive a target luminance value; and determining a first target grayscale value corresponding to the target luminance value from the target luminance value.

Optionally, in the organic electroluminescent display panel according to an embodiment of the present disclosure, for each pixel group, the driving chip is further configured to detect an amount of drift of the threshold voltage of the driving transistor in each sub-pixel one by one at a second detection phase, and to compensate the first target grayscale value for the corresponding sub-pixel at the display phase in accordance with the amount of drift of the threshold voltage of the driving transistor in each sub-pixel.

Optionally, in the organic electroluminescent display panel according to an embodiment of the present disclosure, detecting the amount of drift of the threshold voltage of the driving transistor in each sub-pixel includes:

writing, by the data write unit, a second preset voltage larger than the threshold voltage of the driving transistor to the gate of the driving transistor; providing a first reference signal that is variable and has a voltage value less than a threshold voltage of the light-emitting device to the first reference signal terminal; varying the voltage value of the first reference signal; acquiring, by the detection unit, current values of the driving transistor under different voltages of the first reference signal; and determining the amount of drift of the threshold voltage of the driving transistor using a correspondence between different source-gate voltages and the current values, the source-gate voltage being a difference between the voltage value of the first reference signal and the second preset voltage.

Optionally, in the organic electroluminescent display panel according to an embodiment of the present disclosure, compensating the first target grayscale value for the corresponding sub-pixel in accordance with the amount of drift of the threshold voltage of the driving transistor in each sub-pixel includes:

determining for each sub-pixel an initial driving voltage value corresponding to the first target grayscale value for the sub-pixel; deriving a target driving voltage value by adding the determined initial driving voltage value to the amount of drift of the threshold voltage of the corresponding driving transistor; and determining a second target grayscale value corresponding to the first target grayscale value from the target driving voltage value.

Optionally, in the organic electroluminescent display panel according to an embodiment of the present disclosure, the data write unit includes a first switch transistor. The first switch transistor has a gate connected with the corresponding first gate line, a source connected with the corresponding data line, and a drain connected with the gate of the corresponding driving transistor.

Optionally, in the organic electroluminescent display panel according to an embodiment of the present disclosure, the detection unit includes a second switch transistor. The second switch transistor has a gate connected with the corresponding second gate line, a source connected with a corresponding one of the sense lines, and a drain connected with the source of the corresponding driving transistor.

Optionally, in the organic electroluminescent display panel according to an embodiment of the present disclosure, the driving chip is configured to perform the first detection phase to acquire the aging of the light-emitting devices in the sub-pixels upon the first start-up of the organic electroluminescent display panel during a preset time period, and then to compensate the initial grayscale value for the corresponding sub-pixel at the display phase in accordance with the most-recently acquired aging of the light-emitting device in each sub-pixel.

Optionally, in the organic electroluminescent display panel according to an embodiment of the present disclosure, the driving chip is configured to perform the second detection phase to acquire the amounts of drift of the threshold voltages of the driving transistors in the sub-pixels upon the first start-up of the organic electroluminescent display panel during a preset time period, and then to compensate the first target grayscale value for the corresponding sub-pixel in accordance with the most-recently acquired amount of drift of the threshold voltage in each sub-pixel at the display phase.

A display apparatus is further provided by an embodiment of the present disclosure accordingly, which includes any one of the organic electroluminescent display panels according to the embodiments of the present disclosure as described above.

Embodiments of the present disclosure further provide a method for luminance compensation of an organic electroluminescent display panel, the organic electroluminescent display panel including a plurality of rows of sub-pixels and a driving chip connected with the sub-pixels through respective data lines. At least two adjacent sub-pixels in the same row form a pixel group. The display panel further includes sense lines corresponding one-to-one to the pixel groups, and first gate lines and second gate lines that are connected with respective rows of sub-pixels. Each of the sense lines is connected with a respective signal channel of the driving chip.

The sub-pixel includes a driving transistor, a capacitor connected between a source and a gate of the driving transistor, a data write unit, a detection unit and a light-emitting device. An input terminal of the data write unit is connected with a corresponding one of the data lines, a control terminal thereof is connected with a corresponding one of the first gate lines, and an output terminal thereof is connected with the gate of the driving transistor and a first terminal of the capacitor. An input terminal of the detection unit is connected with the source of the driving transistor, a second terminal of the capacitor and a first terminal of the light-emitting device, respectively, a control terminal thereof is connected with a corresponding one of the second gate lines, and an output terminal thereof is connected with one of the sense lines that corresponds to the pixel group to which the sub-pixel belongs. A drain of the driving transistor is connected with a first reference signal terminal, and a second terminal of the light-emitting device is connected with a second reference signal terminal.

The method includes:

for each pixel group, detecting by the driving chip aging of the light-emitting device in each sub-pixel one by one at a first detection phase; and compensating an initial grayscale value for a corresponding sub-pixel in accordance with the aging of the light-emitting device in each sub-pixel at a display phase.

Optionally, the detecting the aging of the light-emitting device in each sub-pixel includes: writing, by the data write unit, a first preset voltage larger than a threshold voltage of the driving transistor to the gate of the driving transistor; receiving, by the detection unit, a driving current for the driving transistor driving the light-emitting device to emit light; calculating the driving current by calculating an amount of change in a voltage on the corresponding sense line; adjusting a voltage of the gate of the driving transistor until the amount of change in the voltage on the sense line equals a preset value; and determining the aging of the light-emitting device by calculating an amount of change in the voltage of the gate of the driving transistor.

Optionally, the determining the aging of the light-emitting device by calculating the amount of change in the voltage of the gate of the driving transistor includes:

calculating a difference between the voltage of the gate of the driving transistor and the first preset voltage when the amount of change in the voltage on the sense line equals the preset value;

determining an amount of change in a driving voltage for the driving transistor driving the light-emitting device from the difference;

comparing the determined amount of change in the driving voltage with a pre-established correspondence between the amount of change in the driving voltage and a percentage of attenuation of a luminous efficiency of the light-emitting device, to determine the percentage of attenuation of the luminous efficiency of the light-emitting device, wherein the percentage of attenuation of the luminous efficiency represents a ratio of an attenuated luminous efficiency to an initial luminous efficiency of the light-emitting device.

Optionally, the compensating for the corresponding sub-pixel in accordance with the aging of the light-emitting device in each sub-pixel includes:

determining for each sub-pixel an initial luminance value corresponding to the initial grayscale value for the sub-pixel; dividing the determined initial luminance value by the percentage of attenuation of the luminous efficiency of the corresponding light-emitting device to derive a target luminance value; and determining a first target grayscale value corresponding to the target luminance value from the target luminance value.

Optionally, for each pixel group, the driving chip is further configured to detect an amount of drift of the threshold voltage of the driving transistor in each sub-pixel one by one at a second detection phase, and to compensate the first target grayscale value for the corresponding sub-pixel at the display phase in accordance with the amount of drift of the threshold voltage of the driving transistor in each sub-pixel.

Optionally, the detecting the amount of drift of the threshold voltage of the driving transistor in each sub-pixel includes:

writing, by the data write unit, a second preset voltage larger than the threshold voltage of the driving transistor to the gate of the driving transistor; providing a first reference signal that is variable and has a voltage value less than a threshold voltage of the light-emitting device to the first reference signal terminal; varying the voltage value of the first reference signal; acquiring, by the detection unit, current values of the driving transistor under different voltages of the first reference signal; and determining the amount of drift of the threshold voltage of the driving transistor using a correspondence between different source-gate voltages and the current values, the source-gate voltage being a difference between the voltage value of the first reference signal and the second preset voltage.

Optionally, the compensating the first target grayscale value for the corresponding sub-pixel in accordance with the amount of drift of the threshold voltage of the driving transistor in each sub-pixel includes:

determining for each sub-pixel an initial driving voltage value corresponding to the first target grayscale value for the sub-pixel; deriving a target driving voltage value by adding the determined initial driving voltage value to the amount of drift of the threshold voltage of the corresponding driving transistor; and determining a second target grayscale value corresponding to the first target grayscale value from the target driving voltage value.

Optionally, the driving chip is configured to perform the first detection phase to acquire the aging of the light-emitting devices in the sub-pixels upon the first start-up of the organic electroluminescent display panel during a preset time period, and then to compensate the initial grayscale value for the corresponding sub-pixel at the display phase in accordance with the most-recently acquired aging of the light-emitting device in each sub-pixel.

Optionally, the driving chip is configured to perform the second detection phase to acquire the amounts of drift of the threshold voltages of the driving transistors in the sub-pixels upon the first start-up of the organic electroluminescent display panel during a preset time period, and then to compensate the first target grayscale value for the corresponding sub-pixel in accordance with the most-recently acquired amount of drift of the threshold voltage in each sub-pixel at the display phase.

With the organic electroluminescent display panel, the display apparatus, and the method for luminance compensation of an organic electroluminescent display panel according to embodiments of the present disclosure, when the data write unit writes the first preset voltage to the gate of the driving transistor, the driving current for the driving transistor driving the light-emitting device to emit light is received by the detection unit, the driving current is detected by calculating the amount of change in the voltage on the sense line, and the voltage of the gate of the driving transistor is adjusted until the amount of change in the voltage on the sense line equals the preset value. Thereby, the amount of change in the driving voltage is calculated by calculating the amount of change in the voltage of the gate of the driving transistor, and in turn the aging of the corresponding light-emitting device is derived. The initial grayscale value for the corresponding sub-pixel is further compensated in accordance with the aging of the light-emitting device in each sub-pixel, such that in the case that the threshold voltages of the driving transistors are the same, the light-emitting devices of the sub-pixels with different luminous efficiencies still have the same luminance if the input initial grayscale values are the same. That is, the uniformity of the luminance of the display panel is improved. Moreover, in the organic electroluminescent display panel the plurality of sub-pixels belonging to the same pixel group share a sense line. As compared with the prior art where each sub-pixel is connected to a respective sense line, this may facilitate the fabrication of a high resolution display panel by reducing the number of the wirings in the display panel, and reduce the area of the driving chip and thus the manufacture cost by reducing the number of the signal channels of the driving chip.

DETAILED DESCRIPTION

To clearly illustrate the solutions of the embodiments of the present disclosure, the principle of the embodiments of the present disclosure is first explained below.

For the light-emitting devices in the sub-pixels, their luminous efficiencies decrease progressively over time. Given the same initial luminous efficiency, different light-emitting devices may still be subject to different degrees of decrease in the luminous efficiency over time. However, after deriving the aging of the light-emitting devices, the initial grayscale value for each sub-pixel can be compensated in accordance with the aging of the respective light-emitting device in the sub-pixel, such that the actual luminance of the light-emitting device is the same as the luminance of the light-emitting device with the initial luminous efficiency and under the circumstance of the grayscale input to the sub-pixel being the initial grayscale value.

For an organic electroluminescent display panel, the initial luminous efficiencies of the light-emitting devices provided thereon may be regarded as being the same. Thus, if the input initial grayscale value is compensated for the light-emitting device in each of the sub-pixels in accordance with the aging of the light-emitting device, the luminance of the respective light-emitting devices on the whole display panel will be the same in the case that the initial grayscale values for the respective sub-pixels on the display panel are the same.

Of course, the above conclusion is drawn with the other conditions (e.g., the threshold voltages of the driving transistors) being the same for the respective sub-pixels.

Specific implementations of the organic electroluminescent display panel and the display apparatus according to embodiments of the present disclosure are described in detail below in connection with the drawings.

Figure 1:
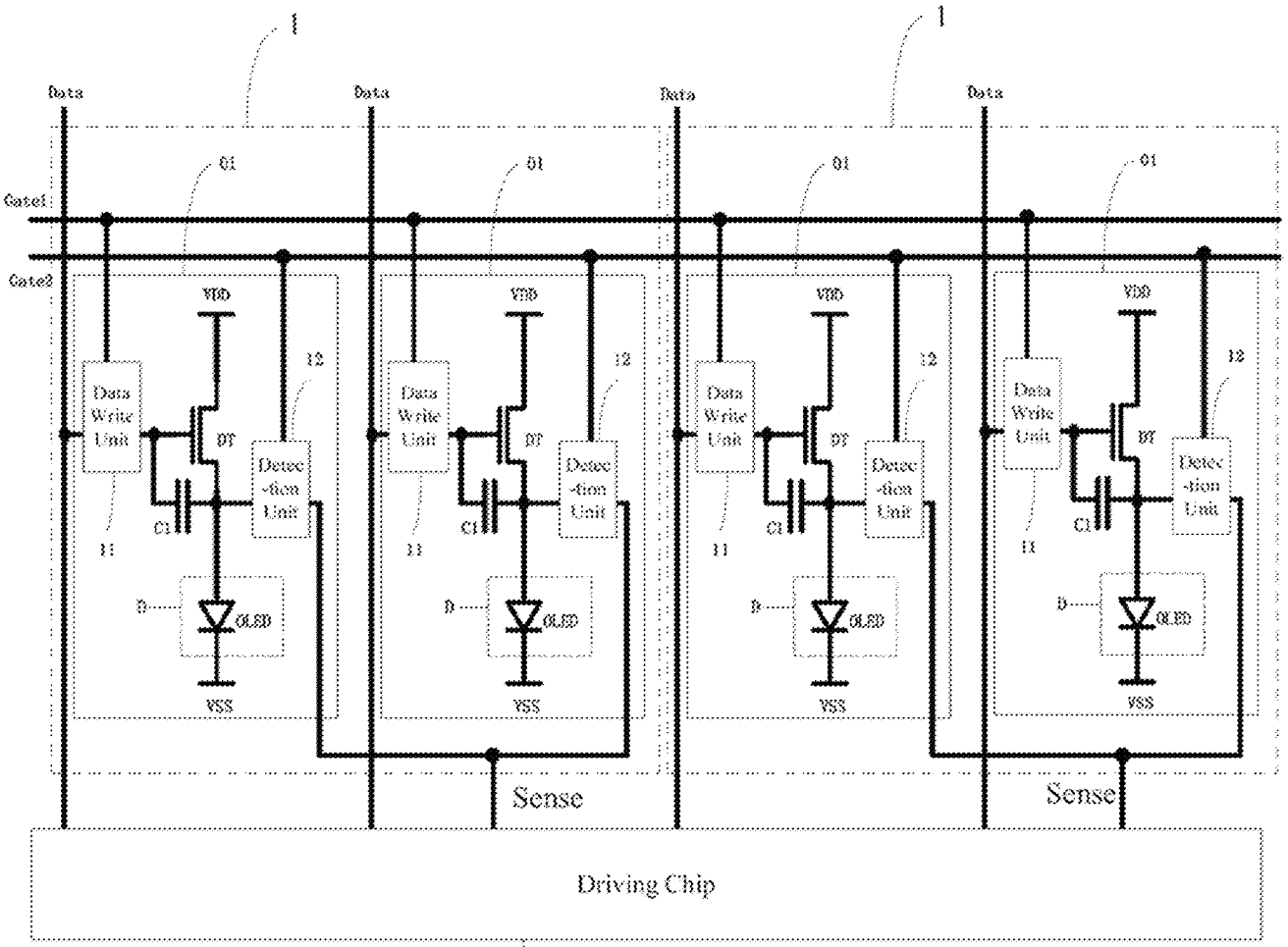
FIG. 1 is a structural schematic diagram of an organic electroluminescent display panel according to an embodiment of the present disclosure.

As shown in FIG. 1, an organic electroluminescent display panel according to an embodiment of the present disclosure includes a plurality of rows of sub-pixels 01 and a driving chip 2 connected with the sub-pixels 01 through respective data lines "Data". At least two adjacent sub-pixels 01 in the same row form a pixel group 1. The display panel further includes sense lines "Sense" corresponding one-to-one to the pixel groups 1, and first gate lines "Gate1" and second gate lines "Gate2" that are located at the same side of the respective rows of sub-pixels 01 and connected with the respective rows of sub-pixels 01 (one row of sub-pixels is taking as an example for illustration in FIG. 1). The sense lines "Sense" are connected respectively with the signal channels (not shown) of the driving chip 2, with each sense line "Sense" corresponding to a respective signal channel.

The sub-pixel 01 includes a driving transistor DT, a capacitor C1 connected between a source and a gate of the driving transistor DT, a data write unit 11, a detection unit 12 and a light-emitting device D. An input terminal of the data write unit 11 is connected with a corresponding one of the data lines "Data", a control terminal thereof is connected with a corresponding one of the first gate lines "Gate1", and an output terminal thereof is connected with the gate of the driving transistor DT and a first terminal of the capacitor C1. An input terminal of the detection unit 12 is connected with the source of the driving transistor DT, a second terminal of the capacitor C1 and a first terminal of the light-emitting device D, respectively, a control terminal thereof is connected with a corresponding one of the second gate lines "Gate2", and an output terminal thereof is connected with one of the sense lines "Sense" that corresponds to the pixel group 1 to which the sub-pixel 01 belongs. A drain of the driving transistor DT is connected with a first reference signal terminal VDD, and a second terminal of the light-emitting device D is connected with a second reference signal terminal VSS.

For each pixel group 1, the driving chip 2 is configured to detect aging of the light-emitting device D in each sub-pixel 01 one by one at a first detection phase, and compensate an initial grayscale value for a corresponding sub-pixel 01 in accordance with the aging of the light-emitting device D in each sub-pixel 01 at a display phase. Optionally, detecting the aging of the light-emitting device D in each sub-pixel 01 includes: writing, by the data write unit 11, a first preset voltage larger than a threshold voltage of the driving transistor to the gate of the driving transistor DT; receiving, by the detection unit 12, a driving current for the driving transistor DT driving the light-emitting device D to emit light; detecting the driving current by calculating an amount of change in a voltage on the corresponding sense line "Sense"; adjusting a voltage of the gate of the driving transistor DT until the amount of change in the voltage on the sense line equals a preset value; and determining the aging of the light-emitting device D by calculating an amount of change in the voltage of the gate of the driving transistor DT.

With the organic electroluminescent display panel according to embodiments of the present disclosure, when the data write unit writes the first preset voltage Vg1 to the gate of the driving transistor, the driving transistor is turned on, and the voltage difference Vgs between the gate and source of the driving transistor meets $Vgs=Vg\mathbf{1}-V_D$, where $V_D$ is a driving voltage on the light-emitting device, i.e., a voltage across the light-emitting device. It can be known from the saturation state current characteristic, the driving current $I_D$ flowing through the driving transistor to driving the light-emitting device to emit light meets the formula: $I_D=K(V_{gs}-V_{th})^2=K(Vg\mathbf{1}-V_D-V_{th1})^2$, where K is a structure parameter which is relatively stable for the same structures and thus may be regarded as a constant. The driving current for the driving transistor driving the light-emitting device is received by the detection unit, and the driving current can be detected by calculating the amount of change in the voltage on the sense line. Due to the aging of the light-emitting device, $V_D$ does not equal to the driving voltage of the light-emitting device with an initial luminous efficiency, leading to a change in the driving current of the light-emitting device. As such, the voltage of the gate of the driving transistor is adjusted until the amount of change in the voltage on the sense line equals a preset value. At this point, the driving current equals to the driving current for the light-emitting device with the initial luminous efficiency, indicating that at this time the driving voltage of the light-emitting device equals to the driving voltage in the case of the light-emitting device having the initial luminous efficiency, namely, the luminance is the same. Thereby, the amount of change in the driving voltage is calculated by calculating the amount of change in the voltage of the gate of the driving transistor, and in turn the aging of the corresponding light-emitting device is derived. The initial grayscale value for the corresponding sub-pixel is further compensated in accordance with the aging of the light-emitting device in each sub-pixel, such that in the case that the threshold voltages of the driving transistors are the same, the light-emitting devices of the sub-pixels with different luminous efficiencies still have the same luminance if the input initial grayscale values are the same. That is, the uniformity of the luminance of the display panel is improved. Moreover, in the organic electroluminescent display panel the plurality of sub-pixels belonging to the same pixel group share a sense line. As compared with the prior art where each sub-pixel is connected to a respective sense line, this may facilitate the fabrication of a high resolution display panel by reducing the number of the wirings in the display panel, and reduce the area of the driving chip and thus the manufacture cost by reducing the number of the signal channels of the driving chip.

In the organic electroluminescent display panel according to an embodiment of the present disclosure, the larger is the number of the sub-pixels in the pixel group, the smaller is the number of the sense lines and however the longer the first detection phase will last. Thus, the number of the sub-pixels in the pixel groups may be set according to actual needs.

Further, in the organic electroluminescent display panel according to an embodiment of the present disclosure, in the case that the sub-pixels in a pixel (e.g., a pixel generally consists of an R sub-pixel, a G sub-pixel and a B sub-pixel, or an R sub-pixel, a G sub-pixel, a B sub-pixel and a W sub-pixel) are located at the same row, these sub-pixels in the pixel may be grouped into a pixel group, i.e., a pixel group is a pixel, although the present disclosure is not so limited.

Figure 2:
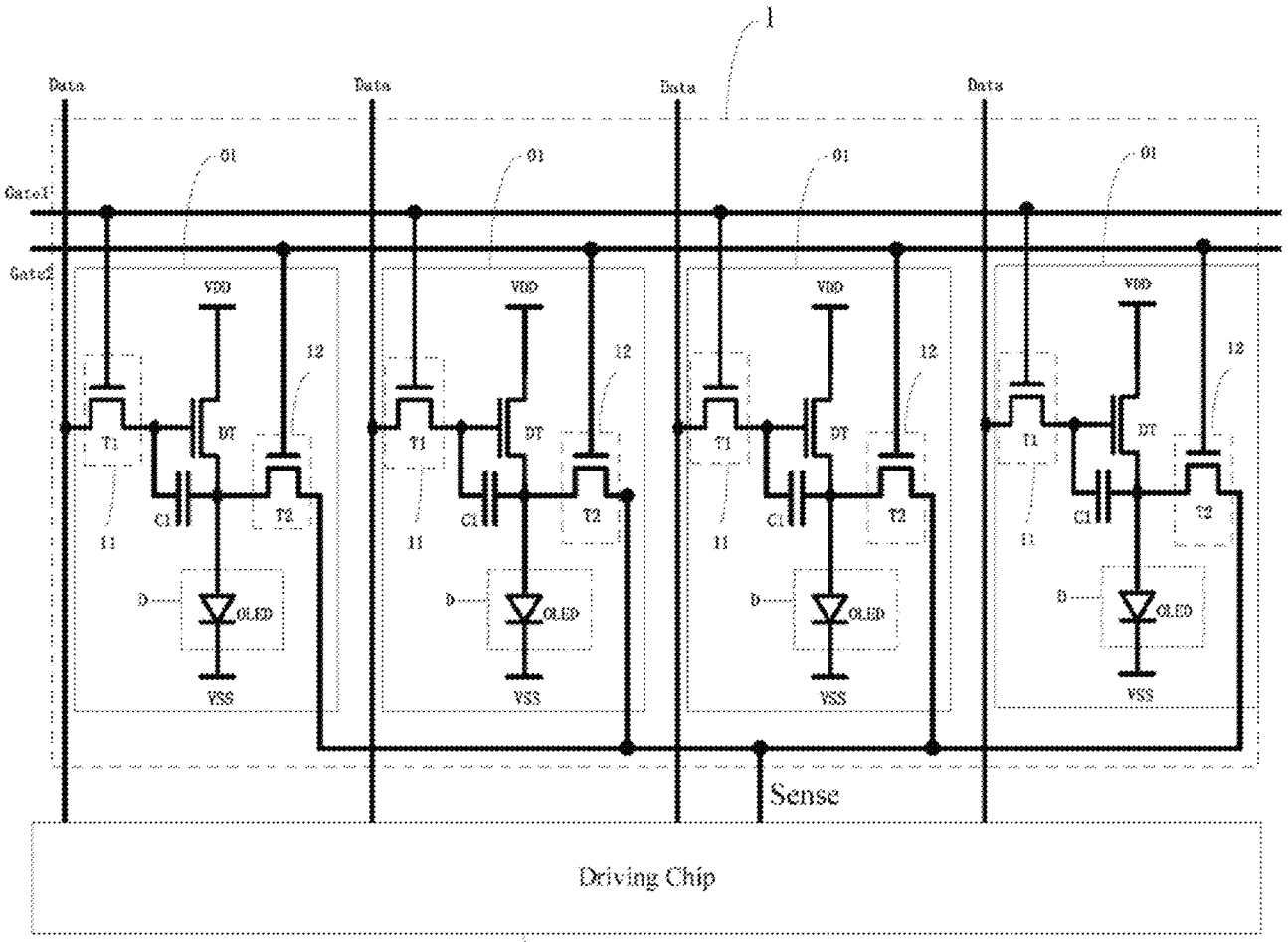
FIG. 2 is a structural schematic diagram of an organic electroluminescent display panel according to an embodiment of the present disclosure.

In implementations, in the organic electroluminescent display panel according to an embodiment of the present disclosure, as shown in FIG. 2, the light-emitting device D is generally an organic light-emitting diode (OLED), although the present disclosure is not so limited.

The present disclosure is described in detail in connection with the embodiments. It is to be noted that the embodiments are for the purposes of better illustrating the present disclosure, not for limiting the present disclosure.

Optionally, in the organic electroluminescent display panel according to an embodiment of the present disclosure, as shown in FIG. 2, the data write unit 11 may specifically include a first switch transistor T1.

The first switch transistor T1 has a gate connected with the corresponding first gate line "Gate1", a source connected with the corresponding data line "Data", and a drain connected with the gate of the corresponding driving transistor DT.

In implementations, when the first gate line controls the first switch transistor to be in a turned-on state, the first switch transistor writes a data signal on the data line to the gate of the driving transistor.

The above is an illustration of a specific structure of the data write unit in the organic electroluminescent display panel. In implementations, the specific structure of the data write unit is not limited to the above structure provided by the embodiment of the present disclosure, and can be other structures that are known to a person skilled in the art. The present disclosure is not so limited.

Optionally, in the organic electroluminescent display panel according to an embodiment of the present disclosure, as shown in FIG. 2, the detection unit 12 may specifically include a second switch transistor T2.

The second switch transistor T2 has a gate connected with the corresponding second gate line "Gate2", a source connected with a corresponding one of the sense lines "Sense", and a drain connected with the source of the corresponding driving transistor DT.

In implementations, when the second gate line controls the second switch transistor to be in a turned-on state, the second switch transistor provides the driving current at the source of the driving transistor to the driving chip through the sense line, such that the driving current of the light-emitting device can be calculated by calculating the amount of change in the voltage on the sense line.

The above is an illustration of a specific structure of the detection unit in the organic electroluminescent display panel. In implementations, the specific structure of the detection unit is not limited to the above structure provided by the embodiment of the present disclosure, and can be other structures that are known to a person skilled in the art. The present disclosure is not so limited.

Optionally, in the organic electroluminescent display panel according to an embodiment of the present disclosure, the driving chip is used to determine the aging of the light-emitting device by calculating the amount of change in the voltage of the gate of the driving transistor. The determining specifically includes:

calculating a difference between the voltage of the gate of the driving transistor and the first preset voltage when the amount of change in the voltage on the sense line equals the preset value;

determining an amount of change in the driving voltage for the driving transistor driving the light-emitting device from the difference;

comparing the determined amount of change in the driving voltage with a pre-established correspondence between the amount of change in the driving voltage and a percentage of attenuation of a luminous efficiency of the light-emitting device, to determine the percentage of attenuation of the luminous efficiency of the light-emitting device. The percentage of attenuation of the luminous efficiency represents a ratio of an attenuated luminous efficiency to an initial luminous efficiency of the light-emitting device.

The working principle of the above display panel according to the embodiment of the present disclosure at the first detection phase is described below in detail by taking a pixel group of the organic electroluminescent display panel as shown in FIG. 2 as an example. For instance, the driving chip detects at the first detection phase the aging of the OLEDs in the first sub-pixel, the second sub-pixel, the third sub-pixel and the fourth sub-pixel one by one.

Figure 3A:
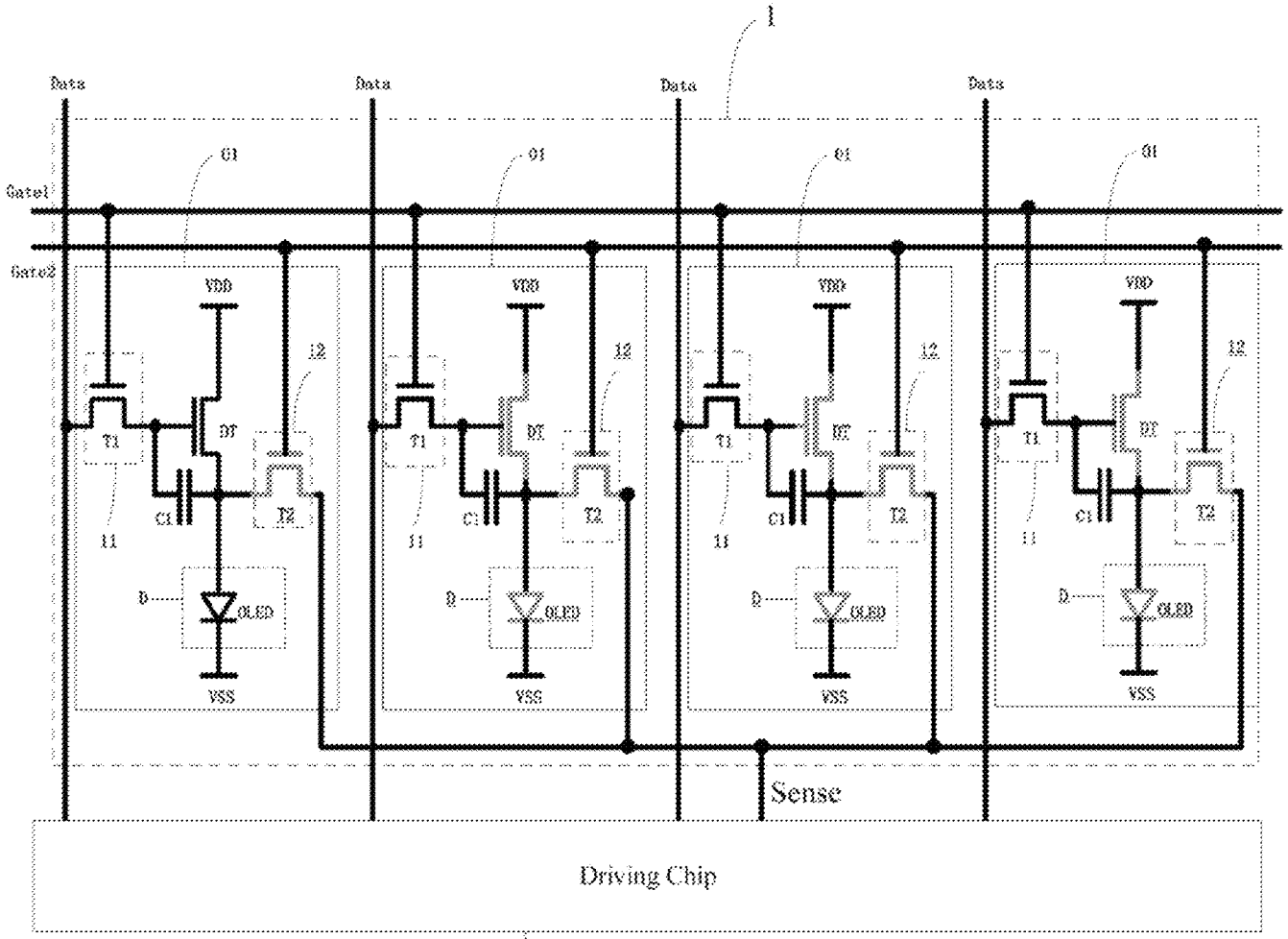
FIGS. 3*a* to 3*c* are schematic diagrams of various phases where a driving voltage of a driving transistor in one of the sub-pixels is detected when the display panel according to an embodiment of the present disclosure is at a first detection phase.

When the first sub-pixel (as shown in the left of FIG. 3*a*) is detected, at a first phase, as shown in FIG. 3*a*, the first gate line "Gate 1" controls the first switch transistor T1 to be in a turned-on state, and the second gate line "Gate2" controls the second switch transistor T2 to be in a turned-off state, such that the sense line "Sense" is in a reset state. The driving chip 2 outputs the first preset voltage Vg1 only to the data line "Data" that is connected with the first sub-pixel, in which case only the driving transistor DT in the first sub-pixel is turned on, and the voltage difference between the gate and source of this driving transistor DT is $Vgs=Vg1-V_{OLED}$, where VOLES is the driving voltage on the OLED.

Figure 3B:
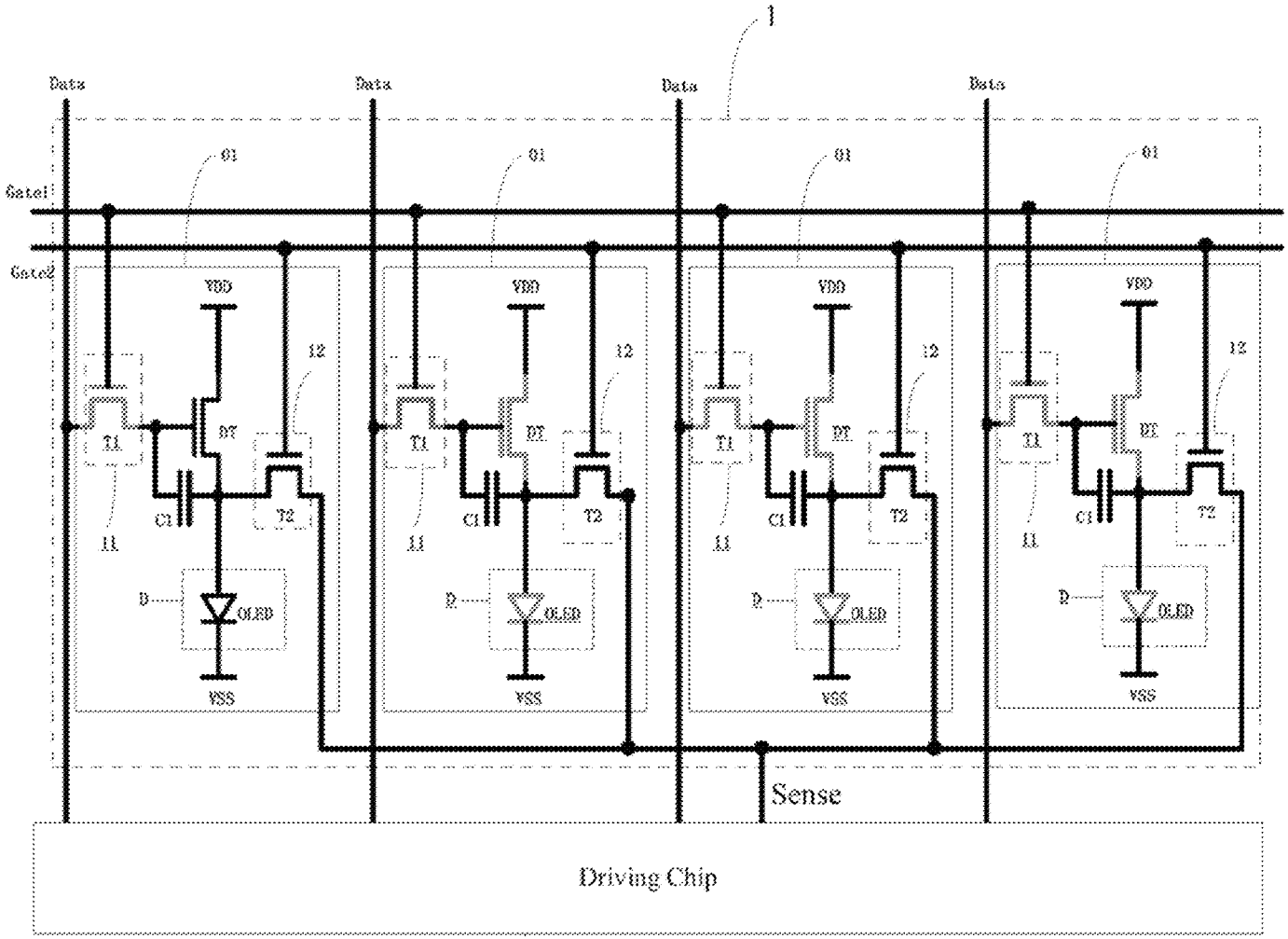

At a second phase, as shown in FIG. 3*b*, the first gate line "Gate1" controls the first switch transistor T1 to be in a turned-off state, and the second gate line "Gate2" controls the second switch transistor T2 to be in a turned-off state. At this point, the driving current flowing through the driving transistor DT in the first sub-pixel to driving the OLED in the first sub-pixel to emit light is $I_{OLED}=K(V_{gs}-V_{th})^2=K(Vg1-V_{OLED}-V_{th1})^2$, and this driving current flows to the sense line "Sense" through the second transistor T2.

Figure 3C:
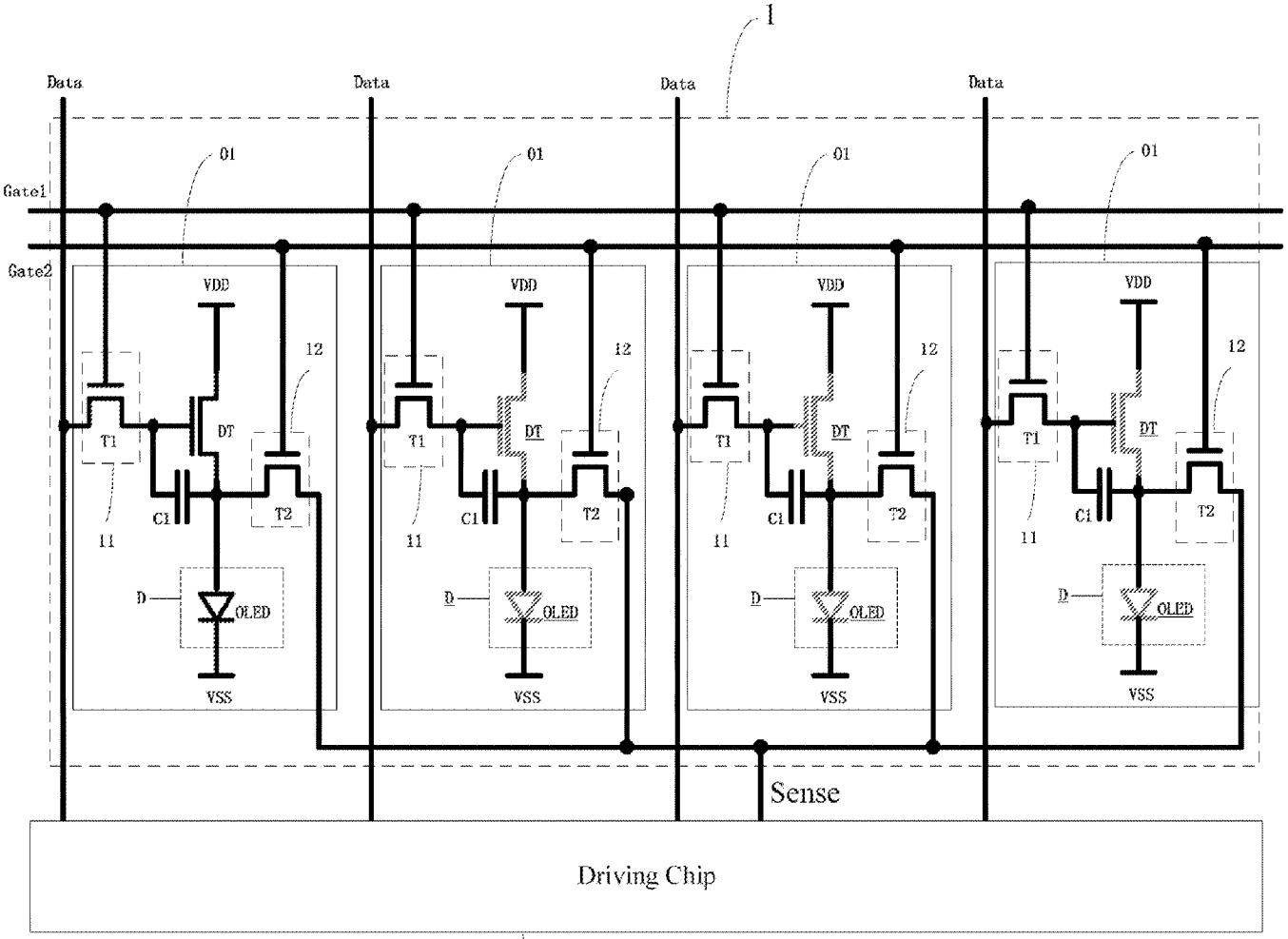

At a third phase, as shown in FIG. 3*c*, the first gate line "Gate1" controls the first switch transistor T1 to be in a turned-on state, and the second gate line "Gate2" controls the second switch transistor T2 to be in a turned-on state. The driving chip 2 receives the driving current for the OLED through the second switch transistor T2, calculates the driving current by calculating the amount of change in the voltage on the sense line, adjusts the signal on the data line "Data" corresponding to the first sub-pixel until the amount of change in the voltage on the sense line "Sense" equals a preset value (at this point, the driving current equals to the driving current for the light-emitting device with the initial luminous efficiency), and determines the amount of change in the driving voltage of the OLED and thus the aging of this OLED in the first sub-pixel by calculating the amount of change in the voltage on the data line "Data" (i.e., the amount of change in the voltage of the gate of the driving transistor).

Thereafter, the driving chip 2 detects the aging of the OLEDs in the second sub-pixel, the third sub-pixel and the fourth sub-pixel one by one. Specifically, the above three phases are also performed in detecting these three sub-pixels, the working principles of which are the same as that of the first sub-pixel, and thus are not discussed here for simplicity.

It is to be noted that in FIGS. 3*a* to 3*c* an underlined reference sign of a device indicates that the device is not in operation and otherwise the device is in operation.

Optionally, in the organic electroluminescent display panel according to an embodiment of the present disclosure, the driving chip is used to compensate for the corresponding sub-pixel in accordance with the aging of the light-emitting device in each sub-pixel. The compensating specifically includes:

determining for each sub-pixel an initial luminance value corresponding to the initial grayscale value for the sub-pixel; dividing the determined initial luminance value by the percentage of attenuation of the luminous efficiency of the corresponding light-emitting device to derive a target luminance value; and determining a first target grayscale value (i.e., the compensated grayscale) corresponding to the target luminance value from the target luminance value.

Figure 4:
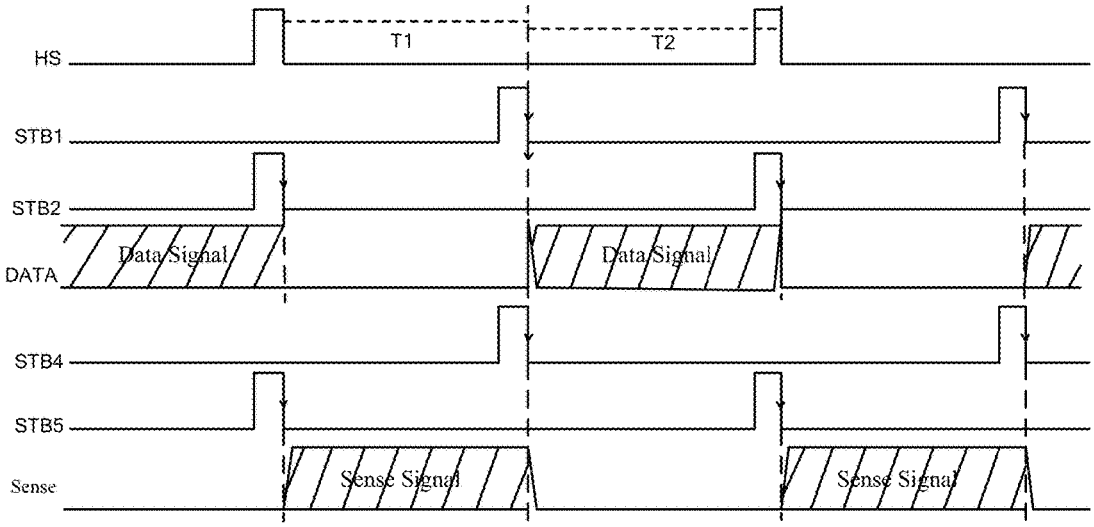
FIG. 4 is a schematic diagram of waveforms for a display panel according to an embodiment of the present disclosure when a driving voltage of a light-emitting device in a sub-pixel is detected.

Specifically, the driving chip may achieve the determination of the percentage of attenuation of the luminous efficiency using the waveforms for detecting the driving voltage of the light-emitting device in the sub-pixel as shown in FIG. 4. Of course, embodiments of the present disclosure are not limited to using the waveforms given in FIG. 4 to achieve the determination of the percentage of attenuation of the luminous efficiency.

In FIG. 4, HS is a horizontal sync signal with each pulse representing a start of a row.

STB1 is a latch signal, by which the data in a shift register is transferred to a latch and the content of the data is displayed by the driving circuit lighting up the light-emitting device.

STB2 is a trigger signal of the data line at the first detection phase, which signal is designed for determining the percentage of attenuation of the luminous efficiency in the embodiment of the present disclosure.

DATA is a data signal that is input to the data line.

STB4 and STB5 are control signals to control the first detection phase and the display phase of the sense line "Sense", which signals are designed for determining the percentage of attenuation of the luminous efficiency in the embodiment of the present disclosure, wherein STB4 is a trigger signal for the display phase of the sense line "Sense", and STB5 is a trigger signal for the first detection phase of the sense line "Sense".

Sense is a signal that is output on the sense line "Sense", and "Sense Signal" is the driving voltage of the light-emitting device.

The first detection phase T1 may be the first time period described above, and the display phase T2 may be the second time period described above.

The start point of the first time period as shown in FIG. 4 is the same as the falling edge of the horizontal sync signal that indicates the start of a period, and the end point of the second time period is the same as the falling edge of the horizontal sync signal that indicates the end of a period. Of course the present disclosure is not limited to the instance where the sum of the durations of these two time periods equals to the duration of a period of the horizontal sync signal. The specific position of the start point of the first time period may be adjusted according to the actual conditions, including the RC parameter of the display panel, the switching time, the output capacity of the driving chip, etc.

Further, in the organic electroluminescent display panel according to an embodiment of the present disclosure, the operations in the first detection phase may be performed each time the display panel starts up to acquire the aging of the light-emitting devices in the sub-pixels, and then at the display phase the initial grayscale value for the corresponding sub-pixel is always compensated in accordance with the most-recently acquired aging of the light-emitting device in each sub-pixel. Of course, in implementations, there may be some instances where the operations in the first detection phase are performed at intervals to acquire the aging of the light-emitting devices in the sub-pixels, and then at the display phase the initial grayscale value for the corresponding sub-pixel is always compensated in accordance with the most-recently acquired aging of the light-emitting device in each sub-pixel until the next time the aging of the light-emitting devices in the sub-pixels is determined.

Optionally, in the organic electroluminescent display panel according to an embodiment of the present disclosure, the driving chip is used to perform the first detection phase to acquire the aging of the light-emitting devices in the sub-pixels upon the first start-up of the organic electroluminescent display panel during a preset time period, and then to compensate the initial grayscale value for the corresponding sub-pixel at the display phase in accordance with the most-recently acquired aging of the light-emitting device in each sub-pixel.

Furthermore, in view of that in practice the threshold voltages of the driving transistors in the sub-pixels also drift over time, and that the amounts of drift of the threshold voltages of the driving transistors in the sub-pixels are different (which will affect the working currents input to the light-emitting devices and thus the uniformity of the displayed images), in addition to compensating the difference in the amounts of attenuation of the luminous efficiencies of the light-emitting devices, the difference in the amounts of drift of the threshold voltages of the driving transistors is to be compensated in order to improve the uniformity of the display panel. There may be some instances where the difference in the amounts of attenuation of the luminous efficiencies of the light-emitting devices in the sub-pixels is compensated first, and then the difference in the amounts of drift of the threshold voltages of the driving transistors in the sub-pixels is compensated. Alternatively, there may be some instances where the difference in the amounts of drift of the threshold voltages of the driving transistors in the sub-pixels is compensated first, and then the difference in the amounts of attenuation of the luminous efficiencies of the light-emitting devices in the sub-pixels is compensated.

The instances where the difference in the amounts of attenuation of the luminous efficiencies of the light-emitting devices is compensated first, and then the difference in the amounts of drift of the threshold voltages of the driving transistors is compensated are described below.

Optionally, in the organic electroluminescent display panel according to an embodiment of the present disclosure, for each pixel group, the driving chip is further used to detect an amount of drift of the threshold voltage of the driving transistor in each sub-pixel one by one at a second detection phase, and to compensate the first target grayscale value for the corresponding sub-pixel at the display phase in accordance with the amount of drift of the threshold voltage of the driving transistor in each sub-pixel.

Optionally, in the organic electroluminescent display panel according to an embodiment of the present disclosure, the driving chip detecting the amount of drift of the threshold voltage of the driving transistor in each sub-pixel specifically includes:

writing, by the data write unit, a second preset voltage to the gate of the driving transistor; providing a first reference signal that is variable and has a voltage value less than a threshold voltage of the light-emitting device to the first reference signal terminal; varying the voltage value of the first reference signal; acquiring, by the detection unit, current values of the driving transistor under different voltages of the first reference signal; and determining the amount of drift of the threshold voltage of the driving transistor using a correspondence between different source-gate voltages and the current values, the source-gate voltage being a difference between the voltage value of the first reference signal and the second preset voltage.

Specifically, upon acquisition of the correspondence of the driving transistor between different source-gate voltages and the current values, the I-V characteristic of the driving transistor is derived. In turn, the threshold voltage of the driving transistor can be derived from the I-V characteristic. The amount of drift of the threshold voltage of the driving transistor can be derived by subtracting a preset standard threshold voltage from the derived threshold voltage of the driving transistor.

Figure 5:
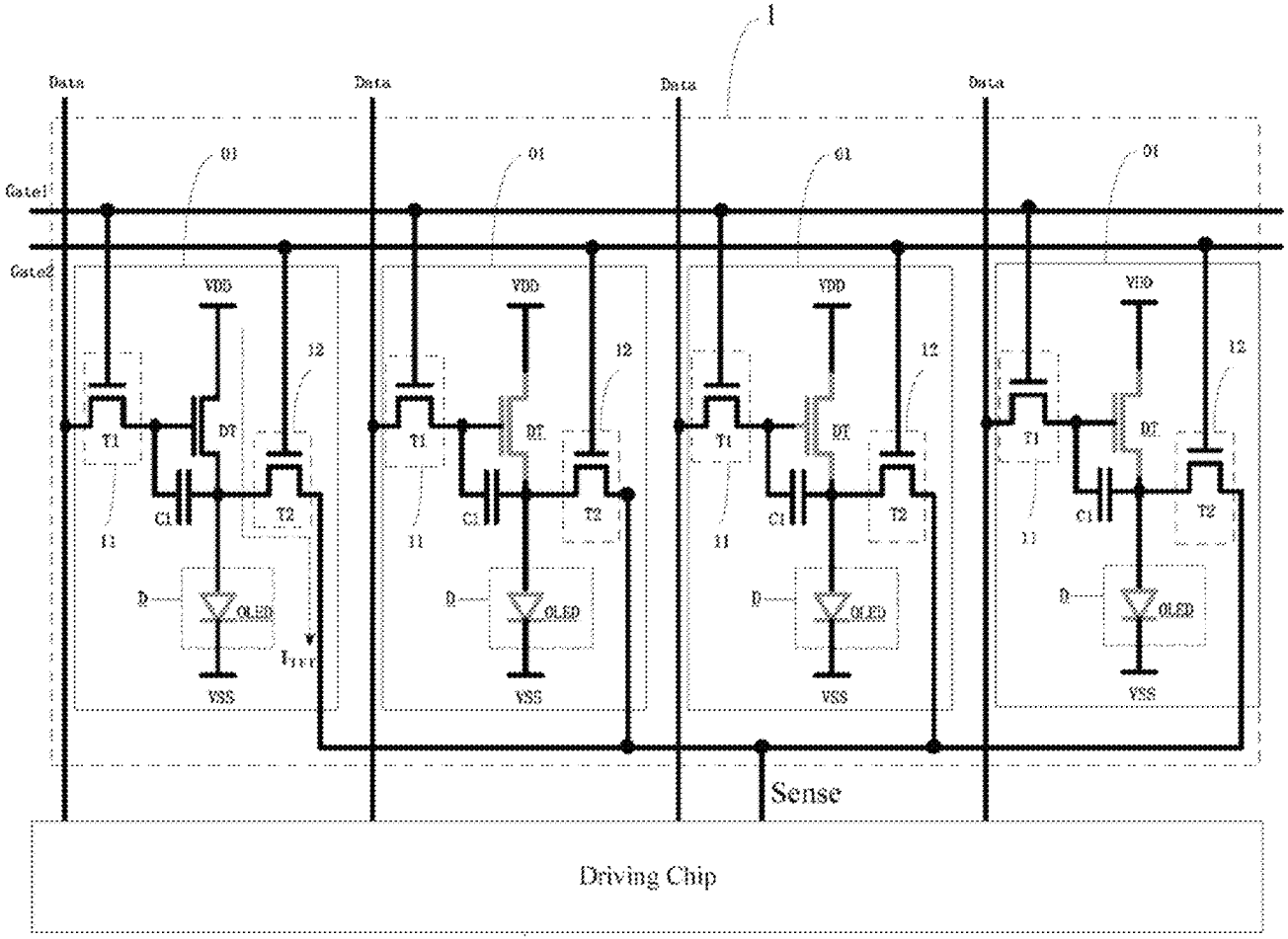
FIG. 5 is a schematic diagram of a display panel according to an embodiment of the present disclosure when it is at a second detection phase where a current of a driving transistor in one of the sub-pixels is detected.

FIG. 5 is a schematic diagram showing that the driving chip 2 is detecting the amount of drift of the threshold voltage of the driving transistor DT in the first sub-pixel at the second detection phase. The reference sign of the OLED device is underlined, indicating that the OLED is not in operation.

Specifically, after the detection of the first sub-pixel, the driving chip detects the amounts of drift of the threshold voltages of the driving transistors in the second sub-pixel, the third sub-pixel and the fourth sub-pixel one by one. The specific working principles for detecting these three sub-pixels are the same as that for the first sub-pixel, and thus are not discussed here for simplicity.

Optionally, in the organic electroluminescent display panel according to an embodiment of the present disclosure, the driving chip is used to compensate the first target grayscale value for the corresponding sub-pixel in accordance with the amount of drift of the threshold voltage of the driving transistor in each sub-pixel. The compensating specifically includes:

determining for each sub-pixel an initial driving voltage value corresponding to the first target grayscale value for the sub-pixel; deriving a target driving voltage value by adding the determined initial driving voltage value to the amount of drift of the threshold voltage of the corresponding driving transistor; and determining a second target grayscale value corresponding to the first target grayscale value from the target driving voltage value.

Specifically, in implementations, in the organic electroluminescent display panel according to an embodiment of the present disclosure, in the instance where the amounts of drift of the threshold voltages of the driving transistors in the sub-pixels are compensated first, and then the difference in the amounts of attenuation of the luminous efficiencies of the light-emitting devices in the sub-pixels is compensated, at the display phase, the first target grayscale value (here the first target grayscale value is the initial grayscale value input during the displaying) is compensated first in accordance with the amount of drift of the threshold voltage of the driving transistor in each sub-pixel to derive a second grayscale value, and then the initial grayscale value (here the initial grayscale value is the derived second grayscale value after the above compensation of the amount of drift of the threshold voltage) for the corresponding sub-pixel is compensated in accordance with the aging of the light-emitting device in each sub-pixel. The specific detection is the same as the above embodiments, and thus is not discussed here for simplicity.

Figure 6:
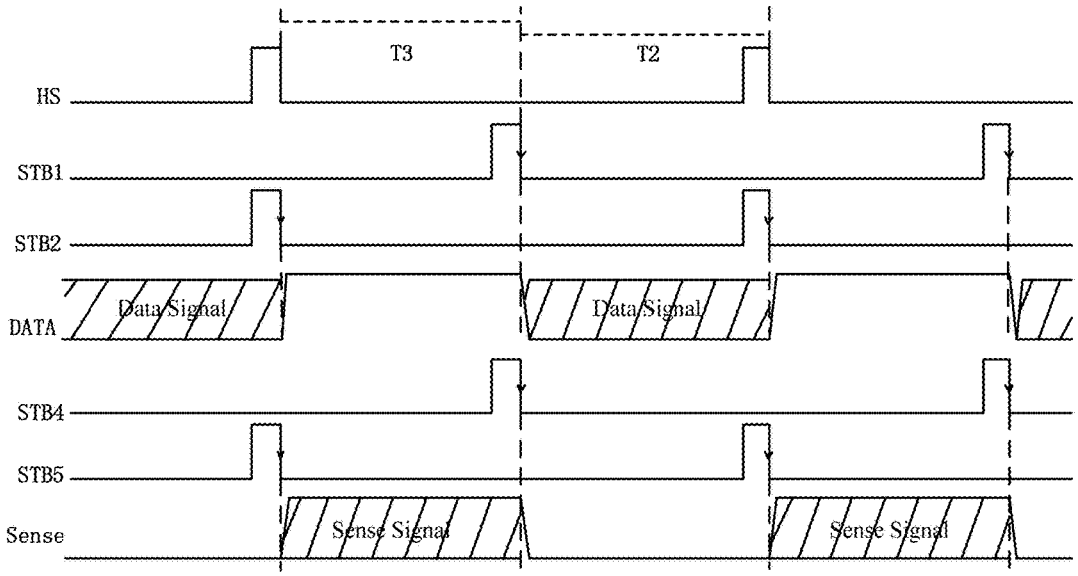
FIG. 6 is a schematic diagram of waveforms for a display panel according to an embodiment of the present disclosure when a current of a driving transistor in a sub-pixel is detected.

Specifically, the driving chip may achieve the determination of the amount of drift of the threshold voltage of the driving transistor using the waveforms for detecting the current of the driving transistor in the sub-pixel as shown in FIG. 6. Of course, embodiments of the present disclosure are not limited to using the waveforms given in FIG. 6 to achieve the determination of the amount of drift of the threshold voltage of the driving transistor.

In FIG. 6, HS is a horizontal sync signal with each pulse representing a start of a row.

STB1 is a latch signal, by which the data in a shift register is transferred to a latch and the content of the data is displayed by the driving circuit lighting up the light-emitting device.

STB2 is a trigger signal of the data line at the second detection phase, which signal is designed for determining the amount of drift of the threshold voltage of the driving transistor in the embodiment of the present disclosure.

DATA is a data signal that is input to the data line.

STB4 and STB5 are control signals to control the second detection phase and the display phase of the sense line "Sense", which signals are designed for determining the amount of drift of the threshold voltage of the driving transistor in the embodiment of the present disclosure, wherein STB4 is a trigger signal for the display phase of the sense line "Sense", and STB5 is a trigger signal for the second detection phase of the sense line "Sense".

The second detection phase T3 may be the first time period described above, and the display phase T2 may be the second time period described above.

The start point of the first time period as shown in FIG. 6 is the same as the falling edge of the horizontal sync signal that indicates the start of a period, and the end point of the second time period is the same as the falling edge of the horizontal sync signal that indicates the end of a period. Of course the present disclosure is not limited to the instance where the sum of the durations of these two time periods equals to the duration of a period of the horizontal sync signal. The specific position of the start point of the first time period may be adjusted according to the actual conditions, including the RC parameter of the display panel, the switching time, the output capacity of the driving chip, etc.

Further, in the organic electroluminescent display panel according to an embodiment of the present disclosure, the operations in the second detection phase may be performed each time the display panel starts up to acquire the amounts of drift of the threshold voltages of the driving transistors in the sub-pixels, and then at the display phase the grayscale value for the corresponding sub-pixel is always compensated in accordance with the most-recently acquired amount of drift of the threshold voltage of the driving transistor in each sub-pixel. Of course, in implementations, there may be some instances where the operations in the second detection phase are performed at intervals to acquire the amounts of drift of the threshold voltages of the driving transistors in the sub-pixels, and then at the display phase the grayscale value for the corresponding sub-pixel is always compensated in accordance with the most-recently acquired amount of drift of the threshold voltage of the driving transistor in each sub-pixel until the next time the amounts of drift of the threshold voltages of the driving transistors in the sub-pixels is determined.

Optionally, in the organic electroluminescent display panel according to an embodiment of the present disclosure, the driving chip is used to perform the first detection phase to acquire the aging of the light-emitting devices in the sub-pixels upon the first start-up of the organic electroluminescent display panel during a preset time period, and then to compensate the initial grayscale value for the corresponding sub-pixel at the display phase in accordance with the most-recently acquired aging of the light-emitting device in each sub-pixel.

Further, in the organic electroluminescent display panel according to an embodiment of the present disclosure, the first detection phase and the second detection phase may be performed successively, namely, the second detection phase is performed immediately after the completion of the first detection phase, and then the display phase is performed. Alternatively, the first detection phase is performed immediately after the completion of the second detection phase, and then the display phase is performed. Of course, the first detection phase and the second detection phase may be performed at intervals, namely, the second detection phase is performed after some time the first detection phase is completed, or the first detection phase is performed after some time the second detection phase is completed. The present disclosure is not so limited.

Based on the same inventive concept, embodiments of the present disclosure further provide a display apparatus, which includes the organic electroluminescent display panels according to the embodiments of the present disclosure as described above. The display apparatus may be a display, a cell phone, a television, a laptop, an all-in-one computer, and so on. It should be understood by an average person skilled in the art that the display apparatus is provided with other indispensable components, which are not discussed here for simplicity and should not be regarded as limiting the present disclosure.

Embodiments of the present disclosure further provide a method for luminance compensation of an organic electroluminescent display panel. The organic electroluminescent display panel includes a plurality of rows of sub-pixels and a driving chip connected with the sub-pixels through respective data lines. At least two adjacent sub-pixels in the same row form a pixel group. The display panel further includes sense lines corresponding one-to-one to the pixel groups, and first gate lines and second gate lines that are connected with respective rows of sub-pixels. Each of the sense lines is connected with a respective signal channel of the driving chip.

The sub-pixel includes a driving transistor, a capacitor connected between a source and a gate of the driving transistor, a data write unit, a detection unit and a light-emitting device. An input terminal of the data write unit is connected with a corresponding one of the data lines, a control terminal thereof is connected with a corresponding one of the first gate lines, and an output terminal thereof is connected with the gate of the driving transistor and a first terminal of the capacitor. An input terminal of the detection unit is connected with the source of the driving transistor, a second terminal of the capacitor and a first terminal of the light-emitting device, respectively, a control terminal thereof is connected with a corresponding one of the second gate lines, and an output terminal thereof is connected with one of the sense lines that corresponds to the pixel group to which the sub-pixel belongs. A drain of the driving transistor is connected with a first reference signal terminal, and a second terminal of the light-emitting device is connected with a second reference signal terminal.

Figure 7:
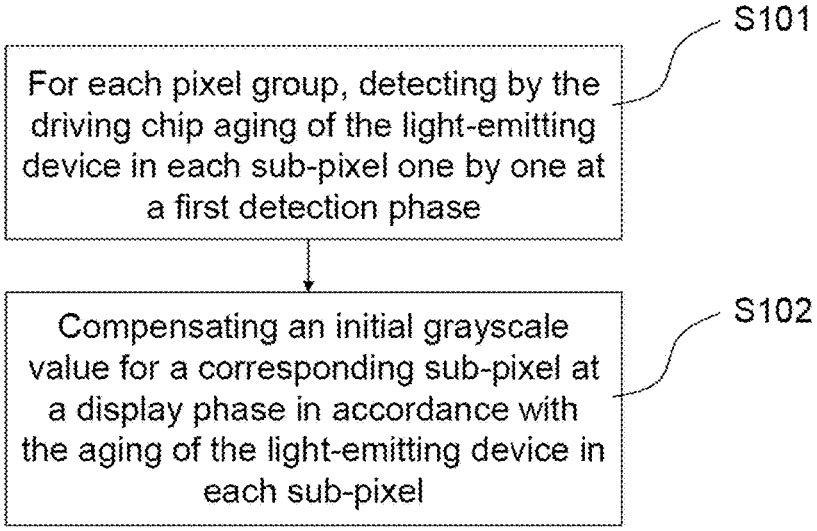
FIG. 7 is a flow chart of a method for luminance compensation of an organic electroluminescent display panel according to an embodiment of the present disclosure.

As shown in FIG. 7, the method includes:

S101: for each pixel group, detecting by the driving chip aging of the light-emitting device in each sub-pixel one by one at a first detection phase; and

S102: compensating an initial grayscale value for a corresponding sub-pixel at a display phase in accordance with the aging of the light-emitting device in each sub-pixel.

Figure 8:
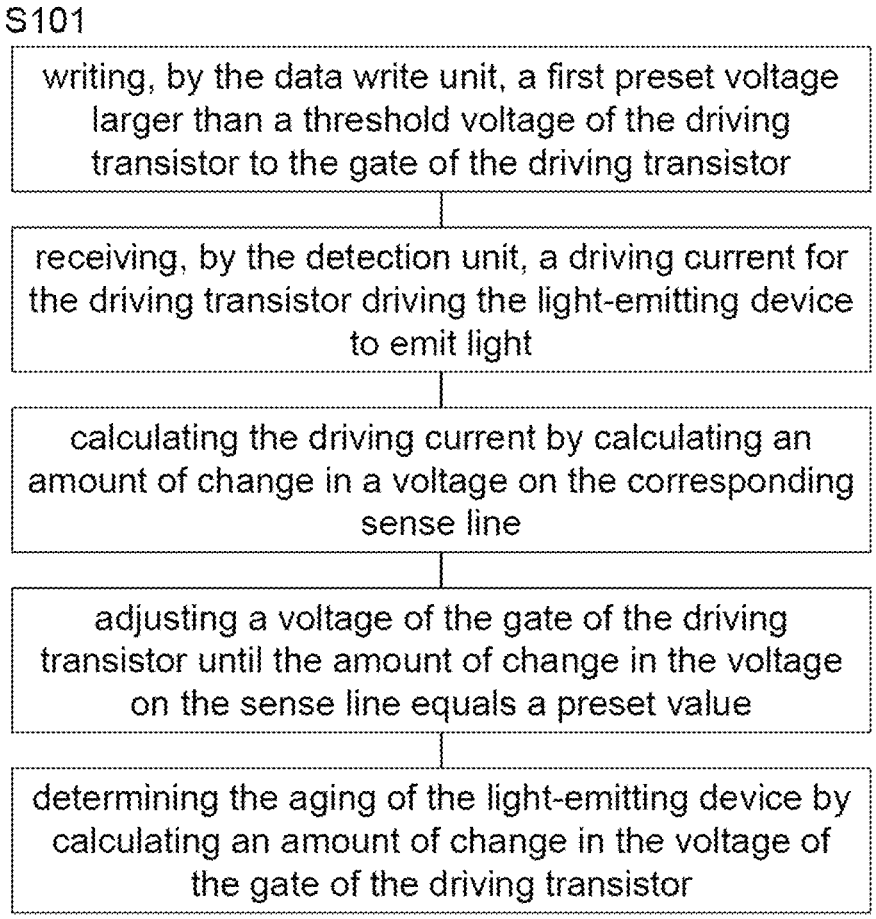
FIG. 8 is a flow chart showing the step of detecting the aging of the light-emitting device in each sub-pixel according to an embodiment of the present disclosure.

Optionally, as shown in FIG. 8, the step of detecting the aging of the light-emitting device in each sub-pixel includes: writing, by the data write unit, a first preset voltage larger than a threshold voltage of the driving transistor to the gate of the driving transistor; receiving, by the detection unit, a driving current for the driving transistor driving the light-emitting device to emit light; calculating the driving current by calculating an amount of change in a voltage on the corresponding sense line; adjusting a voltage of the gate of the driving transistor until the amount of change in the voltage on the sense line equals a preset value; and determining the aging of the light-emitting device by calculating an amount of change in the voltage of the gate of the driving transistor.

Optionally, the determining the aging of the light-emitting device by calculating the amount of change in the voltage of the gate of the driving transistor includes:

calculating a difference between the voltage of the gate of the driving transistor and the first preset voltage when the amount of change in the voltage on the sense line equals the preset value;

determining an amount of change in a driving voltage for the driving transistor driving the light-emitting device from the difference;

comparing the determined amount of change in the driving voltage with a pre-established correspondence between the amount of change in the driving voltage and a percentage of attenuation of a luminous efficiency of the light-emitting device, to determine the percentage of attenuation of the luminous efficiency of the light-emitting device. The percentage of attenuation of the luminous efficiency represents a ratio of an attenuated luminous efficiency to an initial luminous efficiency of the light-emitting device.

Optionally, the compensating for the corresponding sub-pixel in accordance with the aging of the light-emitting device in each sub-pixel includes:

determining for each sub-pixel an initial luminance value corresponding to the initial grayscale value for the sub-pixel; dividing the determined initial luminance value by the percentage of attenuation of the luminous efficiency of the corresponding light-emitting device to derive a target luminance value; and determining a first target grayscale value corresponding to the target luminance value from the target luminance value.

Optionally, for each pixel group, the driving chip is further configured to detect an amount of drift of the threshold voltage of the driving transistor in each sub-pixel one by one at a second detection phase, and to compensate the first target grayscale value for the corresponding sub-pixel at the display phase in accordance with the amount of drift of the threshold voltage of the driving transistor in each sub-pixel.

Optionally, the detecting the amount of drift of the threshold voltage of the driving transistor in each sub-pixel includes:

writing, by the data write unit, a second preset voltage larger than the threshold voltage of the driving transistor to the gate of the driving transistor; providing a first reference signal that is variable and has a voltage value less than a threshold voltage of the light-emitting device to the first reference signal terminal; varying the voltage value of the first reference signal; acquiring, by the detection unit, current values of the driving transistor under different voltages of the first reference signal; and determining the amount of drift of the threshold voltage of the driving transistor using a correspondence between different source-gate voltages and the current values, the source-gate voltage being a difference between the voltage value of the first reference signal and the second preset voltage.

Optionally, the compensating the first target grayscale value for the corresponding sub-pixel in accordance with the amount of drift of the threshold voltage of the driving transistor in each sub-pixel includes:

determining for each sub-pixel an initial driving voltage value corresponding to the first target grayscale value for the sub-pixel; deriving a target driving voltage value by adding the determined initial driving voltage value to the amount of drift of the threshold voltage of the corresponding driving transistor; and determining a second target grayscale value corresponding to the first target grayscale value from the target driving voltage value.

Optionally, the driving chip is configured to perform the first detection phase to acquire the aging of the light-emitting devices in the sub-pixels upon the first start-up of the organic electroluminescent display panel during a preset time period, and then to compensate the initial grayscale value for the corresponding sub-pixel at the display phase in accordance with the most-recently acquired aging of the light-emitting device in each sub-pixel.

Optionally, the driving chip is configured to perform the second detection phase to acquire the amounts of drift of the threshold voltages of the driving transistors in the sub-pixels upon the first start-up of the organic electroluminescent display panel during a preset time period, and then to compensate the first target grayscale value for the corresponding sub-pixel in accordance with the most-recently acquired amount of drift of the threshold voltage in each sub-pixel at the display phase.

With the organic electroluminescent display panel, the display apparatus, and the method for luminance compensation of an organic electroluminescent display panel according to embodiments of the present disclosure, when the data write unit writes the first preset voltage to the gate of the driving transistor, the driving current for the driving transistor driving the light-emitting device to emit light is received by the detection unit, the driving current is detected by calculating the amount of change in the voltage on the sense line, and the voltage of the gate of the driving transistor is adjusted until the amount of change in the voltage on the sense line equals the preset value. Thereby, the amount of change in the driving voltage is calculated by calculating the amount of change in the voltage of the gate of the driving transistor, and in turn the aging of the corresponding light-emitting device is derived. The initial grayscale value for the corresponding sub-pixel is further compensated in accordance with the aging of the light-emitting device in each sub-pixel, such that in the case that the threshold voltages of the driving transistors are the same, the light-emitting devices of the sub-pixels with different luminous efficiencies still have the same luminance if the input initial grayscale values are the same. That is, the uniformity of the luminance of the display panel is improved. Moreover, in the organic electroluminescent display panel the plurality of sub-pixels belonging to the same pixel group share a sense line. As compared with the prior art where each sub-pixel is connected to a respective sense line, this may facilitate the fabrication of a high resolution display panel by reducing the number of the wirings in the display panel, and reduce the area of the driving chip and thus the manufacture cost by reducing the number of the signal channels of the driving chip.

Apparently, various modifications and variations may be made to the present disclosure by those skilled in the art without departing from the spirit and scope of the present disclosure. Thus, if these modifications and variations to the present disclosure fall within the scope of the appended claims and equivalents thereof, the present disclosure is intended to encompass these modifications and variations.

What is claimed is:

1. An organic electroluminescent display panel comprising:

a plurality of rows of sub-pixels and a driving chip connected with the sub-pixels through respective data lines; wherein at least two adjacent sub-pixels in the same row form a pixel group;

the display panel further comprises sense lines corresponding one-to-one to the pixel groups, and first gate lines and second gate lines that are connected with respective rows of sub-pixels, wherein each of the sense lines is connected with a respective signal channel of the driving chip;

the sub-pixel comprising a driving transistor, a capacitor connected between a source and a gate of the driving transistor, a data write unit, a detection unit and a light-emitting device, wherein an input terminal of the data write unit is connected with a corresponding one of the data lines, a control terminal thereof is connected with a corresponding one of the first gate lines, and an output terminal thereof is connected with the gate of the driving transistor and a first terminal of the capacitor, wherein an input terminal of the detection unit is connected with the source of the driving transistor, a second terminal of the capacitor and a first terminal of the light-emitting device, respectively, a control terminal thereof is connected with a corresponding one of the second gate lines, and an output terminal thereof is connected with one of the sense lines that corresponds to the pixel group to which the sub-pixel belongs, and wherein a drain of the driving transistor is connected with a first reference signal terminal, and a second terminal of the light-emitting device is connected with a second reference signal terminal;

wherein for each pixel group, the driving chip is configured to detect aging of the light-emitting device in each sub-pixel one by one at a first detection phase, and compensate an initial grayscale value for a corresponding sub-pixel in accordance with the aging of the light-emitting device in each sub-pixel at a display phase;

wherein the driving chip is further configured for: writing with the data write unit, a first preset voltage larger than a threshold voltage of the driving transistor to the gate of the driving transistor; receiving with the detection unit, a driving current for the driving transistor driving the light-emitting device to emit light; calculating the driving current by calculating an amount of change in a voltage on the corresponding sense line; adjusting a voltage of the gate of the driving transistor until the amount of change in the voltage on the sense line equals a preset value; and determining the aging of the light-emitting device by calculating an amount of change in the voltage of the gate of the driving transistor;

and wherein the driving chip is further configured for:

calculating, by the driving chip, a difference between the voltage of the gate of the driving transistor and the first preset voltage when the amount of change in the voltage on the sense line equals the preset value;

determining an amount of change in a driving voltage for the driving transistor driving the light-emitting device from the difference; and comparing the determined amount of change in the driving voltage with a pre-established correspondence between the amount of change in the driving voltage and a percentage of attenuation of a luminous efficiency of the light-emitting device, to determine the percentage of attenuation of the luminous efficiency of the light-emitting device, wherein the percentage of attenuation of the luminous efficiency represents a ratio of an attenuated luminous efficiency to an initial luminous efficiency of the light-emitting device.

2. The organic electroluminescent display panel as recited in claim 1, wherein the driving chip is further configured for:

determining for each sub-pixel an initial luminance value corresponding to the initial grayscale value for the sub-pixel; dividing the determined initial luminance value by the percentage of attenuation of the luminous efficiency of the corresponding light-emitting device to derive a target luminance value; and determining a first target grayscale value corresponding to the target luminance value from the target luminance value.

3. The organic electroluminescent display panel as recited in claim 2, wherein for each pixel group, the driving chip is further configured to detect an amount of drift of the threshold voltage of the driving transistor in each sub-pixel one by one at a second detection phase, and to compensate the first target grayscale value for the corresponding sub-pixel at the display phase in accordance with the amount of drift of the threshold voltage of the driving transistor in each sub-pixel.

4. The organic electroluminescent display panel as recited in claim 3, wherein detecting the amount of drift of the threshold voltage of the driving transistor in each sub-pixel comprises:

writing, by the data write unit, a second preset voltage larger than the threshold voltage of the driving transistor to the gate of the driving transistor;

providing a first reference signal that is variable and has a voltage value less than a threshold voltage of the light-emitting device to the first reference signal terminal;

varying the voltage value of the first reference signal; acquiring, by the detection unit, current values of the driving transistor under different voltages of the first reference signal; and determining the amount of drift of the threshold voltage of the driving transistor using a correspondence between different source-gate voltages and the current values, the source-gate voltage being a difference between the voltage value of the first reference signal and the second preset voltage.

5. The organic electroluminescent display panel as recited in claim 4, wherein the driving chip is further configured for:

determining, for each sub-pixel an initial driving voltage value corresponding to the first target grayscale value for the sub-pixel;

deriving, a target driving voltage value by adding the determined initial driving voltage value to the amount of drift of the threshold voltage of the corresponding driving transistor; and determining, a second target grayscale value corresponding to the first target grayscale value from the target driving voltage value.

6. The organic electroluminescent display panel as recited in claim 3, wherein the driving chip is configured to perform the second detection phase to acquire the amounts of drift of the threshold voltages of the driving transistors in the sub-pixels upon the first start-up of the organic electroluminescent display panel during a preset time period, and then to compensate the first target grayscale value for the corresponding sub-pixel in accordance with the most-recently acquired amount of drift of the threshold voltage in each sub-pixel at the display phase.

7. The organic electroluminescent display panel as recited in claim 1, wherein characterized in that the data write unit comprises a first switch transistor, wherein the first switch transistor has a gate connected with the corresponding first gate line, a source connected with the corresponding data line, and a drain connected with the gate of the corresponding driving transistor; alternatively, the detection unit comprises a second switch transistor, wherein the second switch transistor has a gate connected with the corresponding second gate line, a source connected with a corresponding one of the sense lines, and a drain connected with the source of the corresponding driving transistor.

8. The organic electroluminescent display panel as recited in claim 1, wherein the driving chip is configured to perform the first detection phase to acquire the aging of the light-emitting devices in the sub-pixels upon the first start-up of the organic electroluminescent display panel during a preset time period, and then to compensate the initial grayscale value for the corresponding sub-pixel at the display phase in accordance with the most-recently acquired aging of the light-emitting device in each sub-pixel.

9. A display apparatus comprising the organic electroluminescent display panel as recited in claim 1.

10. A method for luminance compensation of an organic electroluminescent display panel, the organic electroluminescent display panel comprising a plurality of rows of sub-pixels and a driving chip connected with the sub-pixels through respective data lines, wherein at least two adjacent sub-pixels in the same row form a pixel group; the display panel further comprising sense lines corresponding one-to-one to the pixel groups, and first gate lines and second gate lines that are connected with respective rows of sub-pixels, wherein each of the sense lines is connected with a respective signal channel of the driving chip;

the sub-pixel comprising a driving transistor, a capacitor connected between a source and a gate of the driving transistor, a data write unit, a detection unit and a light-emitting device, wherein an input terminal of the data write unit is connected with a corresponding one of the data lines, a control terminal thereof is connected with a corresponding one of the first gate lines, and an output terminal thereof is connected with the gate of the driving transistor and a first terminal of the capacitor, wherein an input terminal of the detection unit is connected with the source of the driving transistor, a second terminal of the capacitor and a first terminal of the light-emitting device, respectively, a control terminal thereof is connected with a corresponding one of the second gate lines, and an output terminal thereof is connected with one of the sense lines that corresponds to the pixel group to which the sub-pixel belongs, and wherein a drain of the driving transistor is connected with a first reference signal terminal, and a second terminal of the light-emitting device is connected with a second reference signal terminal;

wherein the method comprises:

for each pixel group, detecting by the driving chip aging of the light-emitting device in each sub-pixel one by one at a first detection phase; and compensating an initial grayscale value for a corresponding sub-pixel in accordance with the aging of the light-emitting device in each sub-pixel at a display phase;

wherein detecting the aging of the light-emitting device in each sub-pixel comprises: writing, by the data write unit, a first preset voltage larger than a threshold voltage of the driving transistor to the gate of the driving transistor; receiving, by the detection unit, a driving current for the driving transistor driving the light-emitting device to emit light; calculating the driving current by calculating an amount of change in a voltage on the corresponding sense line; adjusting a voltage of the gate of the driving transistor until the amount of change in the voltage on the sense line equals a preset value; and determining the aging of the light-emitting device by calculating an amount of change in the voltage of the gate of the driving transistor;

and wherein determining the aging of the light-emitting device by calculating the amount of change in the voltage of the gate of the driving transistor comprises:

calculating a difference between the voltage of the gate of the driving transistor and the first preset voltage when the amount of change in the voltage on the sense line equals the preset value;

determining an amount of change in a driving voltage for the driving transistor driving the light-emitting device from the difference;

comparing the determined amount of change in the driving voltage with a pre-established correspondence between the amount of change in the driving voltage and a percentage of attenuation of a luminous efficiency of the light-emitting device, to determine the percentage of attenuation of the luminous efficiency of the light-emitting device, wherein the percentage of attenuation of the luminous efficiency represents a ratio of an attenuated luminous efficiency to an initial luminous efficiency of the light-emitting device.

11. The method as recited in claim 10, wherein the compensating for the corresponding sub-pixel in accordance with the aging of the light-emitting device in each sub-pixel comprises:

determining for each sub-pixel an initial luminance value corresponding to the initial grayscale value for the sub-pixel; dividing the determined initial luminance value by the percentage of attenuation of the luminous efficiency of the corresponding light-emitting device to derive a target luminance value; and determining a first target grayscale value corresponding to the target luminance value from the target luminance value.

12. The method as recited in claim 11, wherein for each pixel group, the driving chip is further configured to detect an amount of drift of the threshold voltage of the driving transistor in each sub-pixel one by one at a second detection phase, and to compensate the first target grayscale value for the corresponding sub-pixel at the display phase in accordance with the amount of drift of the threshold voltage of the driving transistor in each sub-pixel.

13. The method as recited in claim 12, wherein the detecting the amount of drift of the threshold voltage of the driving transistor in each sub-pixel comprises:

writing, by the data write unit, a second preset voltage larger than the threshold voltage of the driving transistor to the gate of the driving transistor;

providing a first reference signal that is variable and has a voltage value less than a threshold voltage of the light-emitting device to the first reference signal terminal;

varying the voltage value of the first reference signal; acquiring, by the detection unit, current values of the driving transistor under different voltages of the first reference signal; and determining the amount of drift of the threshold voltage of the driving transistor using a correspondence between different source-gate voltages and the current values, the source-gate voltage being a difference between the voltage value of the first reference signal and the second preset voltage.

14. The method as recited in claim 13, wherein the compensating the first target grayscale value for the corresponding sub-pixel in accordance with the amount of drift of the threshold voltage of the driving transistor in each sub-pixel comprises:

determining for each sub-pixel an initial driving voltage value corresponding to the first target grayscale value for the sub-pixel;

deriving a target driving voltage value by adding the determined initial driving voltage value to the amount of drift of the threshold voltage of the corresponding driving transistor; and determining a second target grayscale value corresponding to the first target grayscale value from the target driving voltage value.

15. The method as recited in claim 12, wherein the driving chip is configured to perform the second detection phase to acquire the amounts of drift of the threshold voltages of the driving transistors in the sub-pixels upon the first start-up of the organic electroluminescent display panel during a preset time period, and then to compensate the first target grayscale value for the corresponding sub-pixel in accordance with the most-recently acquired amount of drift of the threshold voltage in each sub-pixel at the display phase.

16. The method as recited in claim 10, wherein the driving chip is configured to perform the first detection phase to acquire the aging of the light-emitting devices in the sub-pixels upon the first start-up of the organic electroluminescent display panel during a preset time period, and then to compensate the initial grayscale value for the corresponding sub-pixel at the display phase in accordance with the most-recently acquired aging of the light-emitting device in each sub-pixel.

* * * * *